United States Patent [19]

Morris et al.

[11] 4,008,449

[45] Feb. 15, 1977

[54] ELECTRICAL CONTROL DEVICE AND METHODS OF ADJUSTING AND OPERATING

[75] Inventors: George E. Morris, Sterling; Ronald W. Poling, Morrison, both of Ill.

[73] Assignee: General Electric Company, Fort Wayne, Ind.

[22] Filed: May 27, 1975

[21] Appl. No.: 581,272

[52] U.S. Cl. ..... 335/273; 335/42; 335/176

[51] Int. Cl.[2] ..... H01H 69/01

[58] Field of Search ..... 335/273, 274, 176, 42, 335/228

[56] References Cited

UNITED STATES PATENTS

| | | | |
|---|---|---|---|
| 2,064,631 | 12/1936 | Schmitt | 335/274 |
| 2,728,033 | 12/1955 | Robinson et al. | 335/273 |
| 2,831,934 | 4/1958 | Moran | 335/273 |
| 3,201,659 | 8/1965 | Poulton, Jr. et al. | 335/176 |

FOREIGN PATENTS OR APPLICATIONS

| | | | |
|---|---|---|---|
| 1,280,006 | 11/1961 | France | 335/273 |
| 622,018 | 4/1949 | United Kingdom | 335/273 |

*Primary Examiner*—Harold Broome
*Attorney, Agent, or Firm*—Joseph E. Papin

[57] ABSTRACT

An electrical control device has an electromagnet, and means is adapted for attraction from a generally at-rest position through an air gap into magnetic holding engagement with the electromagnet upon its energization. In combination with the device, there is provided means for adjusting the attraction means toward a selected at-rest position thereof and also means for mounting the adjusting means so that it is rotatable to drive the attraction means toward the selected at-rest position and conjointly linearly movable in a direction generally away from its driving engagement with the attraction means. The adjusting means is conjointly rotatably and linearly movable in response to an applied adjusting force thereon to drive the attraction means toward the selected at-rest position with respect to the electromagnet to adjustably alter the air gap therebetween.

Another electrical control device, a method of adjusting an air gap in an electrical control device, and a method of operating adjusting means for an electrical control device are also disclosed.

26 Claims, 6 Drawing Figures

ELECTRICAL CONTROL DEVICE AND METHODS OF ADJUSTING AND OPERATING

BACKGROUND OF THE INVENTION

This invention relates generally to electrical control devices and in particular to those having means operable generally for adjusting an air gap therein, a method of adjusting an air gap in an electrical control device, and a method of operating adjusting means for an electrical control device.

In the past electrical control devices, such relays or circuit breakers or the like for instance, means, such as an armature, was adapted for attraction from a generally at-rest position through an air gap into magnetic holding engagement with an electromagnet or the like upon the energization thereof. The extent of the air gap or travel between the attraction means or armature from its at-rest position into magnetic holding engagement determines, at least in part, the energy level or pick-up voltage of the electromagnet necessary for attracting the armature into magnetic holding engagement therewith. The armature was usually resiliently loaded to determine, at least in part, the energy level or drop-out voltage of the electromagnet at which it was unable to hold the armature in magnetic engagement. Of course, various and sundry means or mechanisms were provided in the prior art for adjusting the air gap between the electomagnet and the armature thereby to adjustably predetermine the pick-up voltage and also for adjusting the resilient force opposing the magnetic attraction between the armature and the electromagnet thereby to adjustably predetermine the drop-out voltage. One such prior art electrical control device is disclosed in the D. E. Moran U.S. Pat. No. 2,831,934 issued Apr. 22, 1958.

In this patent, as well as other similar prior art disclosures, the pick-up voltage of the disclosed relay was adjusted by turning a generally flat head metal screw threaded into the frame of the relay. As the screw head was moved in or out relative to the relay frame, it generally linearly drove a part of an armature to effect pivotal movement of the armature for adjusting the at-rest position thereof with respect to an electromagnet of the relay to adjustably alter the air gap therebetween. Undoubtedly, this patent discloses many salient and important features; however, it is believed that one of the disadvantageous or undesirable features encountered in utilizing this particular type of prior art adjusting means, as well as others, was its limited applicability with respect to different sized or rated electrical control devices. For instance, screws of different lengths may be required in different rated electrical control devices to cover the required adjusting range thereof and prevent the screws from touching an electrical coil of the electromagnet or other electrically hot parts of the relay.

Another disadvantageous or undesirable feature of adjusting means for at least some of the other prior art electrical control devices is believed to be that separate adjusting screws, such as that discussed above, were necessary to effect the desired force and air gap adjustments.

With respect to still further other prior art electrical control devices, a cam was rotatably engaged with the armature to effect the desired resilient force and air gap adjustments for such past electrical control devices. However, one of the disadvantageous or undesirable features of the past rotatable, cam type, adjusting means is believed to be that its rotatable adjusting movement was too coarse to achieve the rather fine adjustment necessary for predetermining the pick-up and drop-out voltages of electrical control devices as may be encountered in a production line assembly for instance.

SUMMARY OF THE INVENTION

Among the several objects of the present invention may be noted the provision of an electrical control device having means operable generally for adjusting it, a method of adjusting an electrical control device, and a method of operating adjusting means for an electrical control device which overcome the disadvantageous or undesirable features discussed hereinabove, as well as others, with respect to the prior art; the provision of such electrical control device and such operating and adjusting methods wherein the adjusting means is conjointly rotatably and generally linearly movable; the provision of such electrical control device and such operating and adjusting methods wherein the resulting adjusting movement of means adapted for attraction into magnetic holding engagement with an electromagnet to adjustably alter the air gap therebetween is a function of both the rotatable and generally linear movements of the adjusting means; the provision of such electrical control devices and such operating and adjusting methods in which a rather fine adjusting movement of the adjusting means is achieved; and the provision of such electrical control device and such adjusting and operating methods in which the adjusting means is operable generally through a plurality of predetermined adjusting ranges; the provision of such electrical control device and such operating and adjusting methods in which the adjusting means is automatically reset between the predetermined adjusting ranges wherein the adjusting means may be universally applicable to electrical control devices of several different sizes or electrical ratings. These as well as other objects and advantageous features of the present invention will be in part apparent and in part pointed out hereinafter.

In general, an electrical control device in one form of the invention has an electromagnet, and means is adapted for attraction from a generally at-rest position through an air gap into magnetic holding engagement with the electromagnet upon its energization. Means is provided for adjusting the attraction means toward a selected at-rest position thereof, and means is also provided for mounting the adjusting means so that it is rotatable to drive the attraction means toward the at-rest position and conjointly linearly movable in a direction generally away from its driving engagement with the attraction means. The adjusting means is conjointly rotatably and linearly movable in response to an applied adjusting force thereon to drive the attraction means toward the selected at-rest positions with respect to the electromagnet to adjustably alter the air gap therebetween.

Also in general and in one form of the invention, an electrical control device has an electromagnet, and means is adapted for attraction from a generally at-rest position through an air gap into magnetic holding engagement with the electromagnet upon its energization. Means is engaged with the attraction means and moveable through a plurality of predetermined adjusting ranges for driving the attraction means toward selected at-rest positions to alter the air gap. The driving means is movable in response to an applied adjusting force thereon in one of the predetermined adjusting ranges to drive the attraction means to one of the selected at-rest positions so as to alter the air gap. The driving means include means for automatically resetting it into at least another of the predetermined adjusting ranges upon the applied adjusting force movement of the driving means through the one predetermined adjusting range, and the driving means is operable generally in response to the applied adjusting force movement thereof in the other predetermined adjusting range to effect further driving of the attraction means toward at least another of the selected at-rest positions thereof to further alter the air gap.

In general, a method in one form of the invention is provided for adjusting an air gap in an electrical control device. The electrical control device includes an electromagnet, and means is adapted for attraction from a generally at-rest position into magnetic holding engagement with the electromagnet. In this adjusting method, simultaneously rotating and linearly moving of means engaged with the attraction means is effected for camming it toward a selected at-rest position with respect to the electromagnet to adjustably alter the air gap therebetween.

Also in general and in one form of the invention, an electrical control device has an electromagnet, and means is adapted for attraction from an at-rest position through an air gap into magnetic holding engagement with the electromagnet upon its energization. A method is provided for operating means through a plurality of predetermined adjusting ranges, such means being engaged with the attraction means for adjusting it toward a selected at-rest position to adjustably alter the air gap. In this operating method, the adjusting means is moved within one of the predetermined adjusting ranges in response to an applied adjusting force to drive the attraction means to a selected one of the at-rest positions thereof so as to adjustably alter the air gap. The adjusting means is automatically reset upon its applied adjusting force movement through the one predetermined adjusting range into at least another of the predetermined adjusting ranges, and the adjusting means is operable therein to effect the further driving of the attraction means to at least another selected one of the at-rest positions thereof to further adjustably alter the air gap.

BRIEF DESCRIPTION OF THE DRAWINGS

Corresponding reference characters indicate corresponding parts throughout the several view of the drawings.

The exemplifications set out herein illustrate the preferred embodiments of the invention in one form thereof, and such exemplifications are not to be construed as limiting, in any manner, with respect to the scope of the disclosure or of the invention.

DETAILED DESCRIPTION OF THE PREFERRED EMBODIMENT

Figure 1:
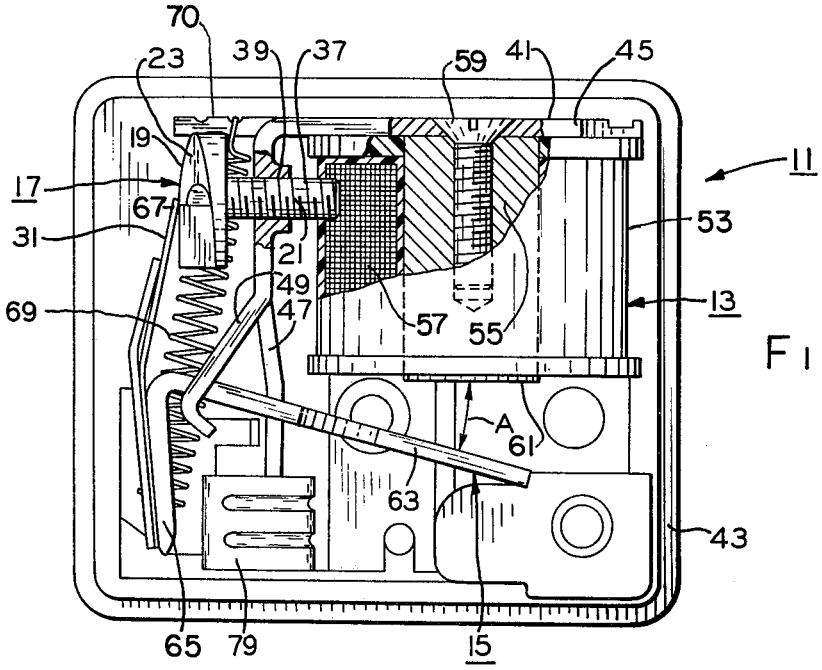
FIG. 1 is a plan view showing an electrical control device in one form of the invention and teaching principles which may be practiced in a method of adjusting an air gap in an electrical control device and also a method of operating an adjusting means in an electrical control device, such adjusting method and operating method respectively being in one form of the invention.

Referring now to the drawings in general, there is illustrated in one form of the invention a method of adjusting an air gap A in an electrical control device 11, such as a relay, circuit breaker or the like, between an electromagnet 13 thereof and means, such as an armature 15, adapted for attraction from a generally at-rest position into magnetic holding engagement with the electromagnet (FIG. 1). In this adjusting method, simultaneously rotating and linearly moving means, such as an adjusting mechanism 17, which is engaged with the attraction means or armature 15, is effected for adjusting or camming the armature toward a selected at-rest position (not shown) with respect to electromagnet 13 to adjustably alter air gap A therebetween (FIGS. 1 and 3–6).

Figure 3:
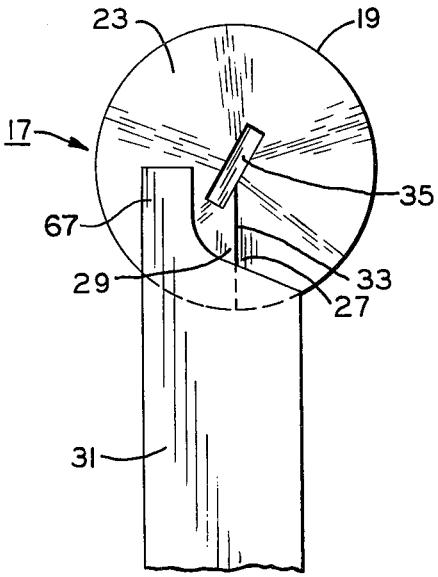
FIG. 3 is an enlarged fragmentary view of the adjusting means for the electrical control device taken from FIG. 1.
Figure 5:
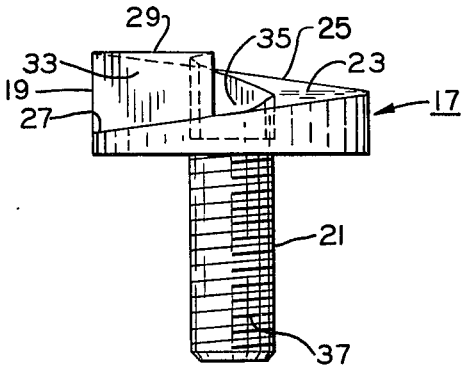
FIG. 5 is an elevational view of the adjusting means shown in FIG. 1.
Figure 4:
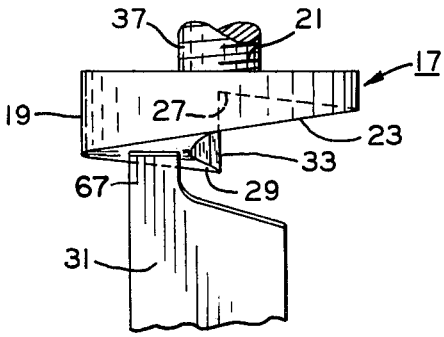
FIG. 4 is an elevational view of the adjusting means of FIG. 3.

More particularly and with specific reference to FIGS. 1 and 5, adjusting or camming means 17 has a head portion 19 and a threaded shank or screw end portion 21 extends integrally from the head portion. Head portion 19 includes a generally annular or spiral cam surface 23 having a predetermined, generally continuous rise 25 between a low end or rise portion 27 and a high end or rise portion 29. Cam surface 23 is engaged with a resilient leg 31 or armature 15, as also shown in FIGS. 3 and 4, wherein, armature 15 may be adjustably moved or pivoted between selected ones of its at-rest positions with respect to electromagnet 13 upon the rotation or adjusting means 17 to drive the cam surface thereof into engagement with the resilient leg of the armature, as discussed in greater detail hereinafter. Between lower and upper ends 27, 29 of cam surface 23, there is provided means, such as a step or cam surface drop 33, for translating or automatically resetting resilient leg 31 from the upper end to the lower end of the cam surface upon the rotation of adjusting means 17. In effect, as adjusting means 17 is rotated one revolution from the engagement of resilient leg 31 with lower end 27 of cam surface 23 toward upper end 29 thereof, the translating or resetting means or step 33 delineates a predetermined adjusting range of the adjusting means, as may be seen between points O and B on the abscissa of the graphical representation in FIG. 6 and as discussed in greater detail hereinafter. While the particular configuration of cam surface 23 is shown and discussed herein for purposes of disclosure, it is contemplated that other cam surface configurations may be utilized within the scope of the invention so as to generally conform with the attendent objects and advantageous features thereof. A tool receiving recess 35 is also provided in head portion 19 of adjusting means 17 into which a tool, such as a screwdriver or the like (not shown), may be inserted to exert an applied or manual adjusting force on the adjusting means for rotating it.

Threaded shank 21 is provided with continuous threads 37 of a selected pitch, and the threaded shank is mounted or received in threaded engagement within a topped, threaded aperture or opening 39 provided therefore in a metallic support or frame 41 of electrical control device 11. It may be noted that the threaded engagement of threaded shank 21 in support opening 39 is effective to provide generally linear movement of adjusting means 17 with respect to resilient leg 31 of armature 15 conjointly with the rotative movement of the adjusting means in response to the applied adjusting force thereon, as previously mentioned. In this manner, the conjoint rotating and linear moving of adjusting means 17 effects a finer or more accurate adjustment of the selected at-rest position of armature 15, i.e., as compared with an adjustment of the armature if the camming means was only rotatably movable without being conjointly linearly movable. It is contemplated that at least threaded shank 21 of adjusting 17 may be of molded plastic or the like with threads 37 thereof being slightly larger than the support threaded opening 39 so as to provide friction opposing the applied adjusting force rotation of adjusting means 17, and the plastic form of the threaded shank will, of course, eliminate voltage breakdown between it and electromagnet 13.

Figure 6:
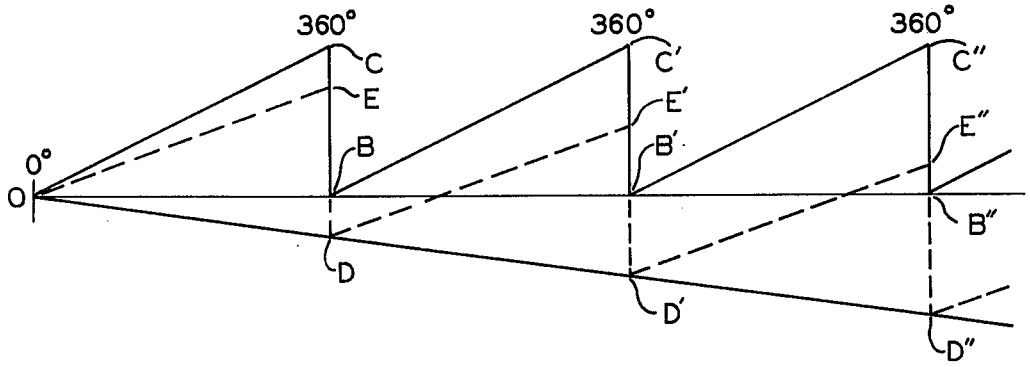
FIG. 6 is a graphical representation of the predetermined adjusting ranges for the adjusting means shown in FIG. 1 illustrating the resultant movement of the armature to its adjusted at-rest positions as a function of the rotational and generally linear movements of the adjusting means.

The conjoint rotation and linear movement of adjusting means 17 in response to the applied adjusting force acting thereon is illustrated in the graphical representation of FIG. 6. For instance, during the first predetermined adjusting range between points O, B on the abscissa, the rotation of adjusting means 17 and its cam surface 23 through one complete revolution moves the cam surface from the origin or point O (0°), where resilient leg 31 engages lower end 27 of the cam surface, toward point C (360°) where the resilient leg engages upper end 29 of the cam surface. Therefore, line OC represents rise 25 of cam surface 23. During this rotative movement of adjusting means 17, the threaded engagement of threaded shank 21 with its associated support opening 39 effects the conjoint linear movement of the adjusting means, and this conjoint linear movement is represented by line OD in the graphical representation of FIG. 6. The slope of line OD is, of course, dependent upon the pitch of threads 37 on threaded shank 21, and the conjoint linear movement of adjusting means 17 is illustrated as negative, i.e., below the abscissa, since it tends to move cam surface 23 in a direction generally away from its engagement with resilient leg 31 when the adjusting means is rotated in the direction to move upper end 29 of the cam surface toward engagement with the resilient leg. In this manner, it may be noted that the resultant movement of armature 15, as represented by line OE, toward a selected one of its at-rest positions to adjustably alter air gap A is a function or functional relationship of the conjoint rotative and linear movements of adjusting means 17. This functional relationship effects the finer adjusting or operating mode of adjusting means 17, as previously mentioned.

Referring again in general to the drawings and recapitulating, at least in part, with respect to the foregoing discussion, there is also illustrated a method in one form of the invention for operating adjusting means 17 through a plurality of predetermined adjusting ranges OB, BB′ and B′B″ with the adjusting means engaged with armature 15 for adjusting it toward a selected at-rest position thereof to adjustably alter air gap A (FIGS. 1 and 6). In this operating method, adjusting means 17 is moved within one of the predetermined adjusting ranges OB in response to an applied adjusting force to drive armature 15 to a selected one of the at-rest positions thereof so as to adjustably alter air gap A. Upon its applied adjusting force movement through the one predetermined adjusting range OB, adjusting means 17 is automatically reset into at least another of the predetermined adjusting ranges BB′ or B′B″, and the adjusting means is thereafter operated in the at least another predetermined adjusting ranges BB′ or B′B″ to effect the further driving of armature 15 to at least another selected one of the at-rest positions thereof to further adjustably alter air gap A (FIGS. 1 and 6).

More particularly and with specific reference to FIGS. 1 and 3–6, when adjusting means 17 is rotated through one complete revolution within the predetermined adjusting range OB, as previously discussed, step 33 of cam surface 23 is brought into registry with resilient leg 31 at point C of the graphical representation in FIG. 6. Upon the establishment of such registry, resilient leg 31 drops or is translated from upper end 29 of cam surface 23 back into engagement with lower end 27 thereof, as represented by line CEB in the graphical representation of FIG. 6. In this manner, adjusting means 17 is automatically reset for operation through the next successive predetermined adjusting range BB′ when resilient leg 31 is so translated into re-engagement with lower end 27 of cam surface 23. Of course, further operation or actuation of adjusting means 17 within predetermined adjusting range BB′ is generally the same as that discussed hereinabove with respect to the operation of the adjusting means within its adjusting range OB; therefore, for the sake of brevity, a further detailed discussion of the operation of the adjusting means in its adjusting range BB′ is omitted. However, during the next successive complete revolution of adjusting means 17, as shown by line BC′ in the graphical representation of FIG. 6, within adjusting range BB′, the conjoint linear movement of the adjusting means, as illustrated by line DD′, is again effected by further threaded engagement of threaded shank 21 with its associated support opening 39. As a result, cam surface 23 of adjusting means 17 is further moved or threadedly displaced in the linear direction generally away from its camming engagement with resilient leg 31. Therefore, it may be noted that the resultant movement of armature 15, as exemplified by the line DE′ in FIG. 6, within adjusting range BB′ for effecting the adjustable altering of air gap A is less than its corresponding resultant movement in adjusting range OB even though the functional relationship of such resultant movements with the conjoint rotational and linear movements of adjusting means 17 is the same. The difference between the resultant movements of armature 15 in adjusting ranges OB and BB′ is illustrated by the difference in height or lengths of lines EB and E′B′, respectively. These resultant movement differences of armature 15 are, of course, effected by the pitch of threads 37 on threaded shank 21 wherein line DD′ within adjusting range BB′ (as well as line D′D″ within adjusting range B′B″) is a generally straight line extension of line OD within operating range OB; therefore, the slope of lines OD, DD′ and D′D″ become increasingly more negative with respect to the abscissa. It may be noted that the predetermined differences between the resultant movements EB, E′B′ and E″B″ of armature 15 within adjusting ranges OB, BB′ and B′B″ exemplifies the feature that adjusting means 17 may be utilized in several electrical control devices of different sizes or electrical ratings each of which require different adjustments in different adjusting ranges.

Figure 2:
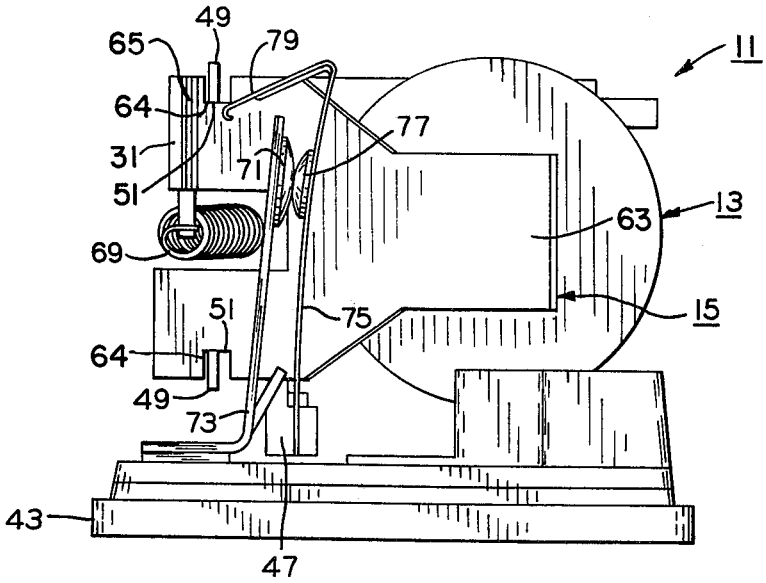
FIG. 2 is a front elevational view of the electrical control device of FIG. 1.

In FIGS. 1 and 2, there is shown electrical control device 11 in one form of the invention. In general and again recapitulating at least in part with respect to the foregoing discussion, electrical control device 11 has electromagnet 13, and armature 15 is adapted for attraction from a generally at-rest position through air gap A into magnetic holding engagement with the electromagnet upon its energization. Adjusting means 17 is provided for adjusting or moving armature 15 toward a selected at-rest position thereof, and means, such as at least threaded shank 21, for mounting the adjusting means is also provided so that the adjusting means is rotatable to drive the armature toward the selected at-rest position and conjointly linearly movable in a direction generally away from its driving engagement with the armature. Adjusting means 17 is rotatably and linearly movable in response to the applied adjusting force thereon to drive armature 15 toward the selected at-rest position thereof with respect to electro-magnet 13 to adjustably alter air gap A therebetween.

More particularly and with specific reference to FIG. 1, support 41 of electrical control device 11 may be integrally molded with or otherwise attached by suitable means well known to the art (not shown) to a base 43 of suitable dielectric material for the electrical control device. Support 41 has a pair of angularly bent arms 45, 47, and arm 47 includes a pair of bifurcated portions 49 so as to provide a pivot seat 51 to which armature 15 is pivotally mounted or engaged, as discussed hereinafter. Opening 39, in which threaded shank 21 of adjusting means 17 is threadedly received as previously mentioned, is provided through arm 47 adjacent the bend between arms 45, 47.

Electromagnet 13 is provided with a spool 53 of suitable electrical insulating or dielectric material which extends about a generally cylindric pole piece 55 of suitable magnetizable metal for the electromagnet. A coil 57, which is adapted to be energized for magnetizing pole piece 55, is wound on the spool about the pole piece in a manner well known to the art. Electromagnet 13 is mounted to support arm 45 by a screw 59 which extends therethrough into mounting or threaded engagement with one end of pole piece 55, the other or free end 61 of which is adapted for magnetic holding engagement with armature 15, as discussed hereinafter.

Armature 15 may be of any suitable magnetizable metal and includes a generally elongate lever portion 63 adapted for magnetic holding engagement with free end 61 of pole piece 55 and also a depending tongue 65 which is integral with the lever portion. Lever portion 63 is notched at 64 adjacent tongue 65 so as to be pivotally engaged or pivotally mounted to its associated pivot seal 51 on bifurcated portions 49 of support arm 47, and resilient leg or leaf spring 31 has one end riveted to or otherwise fixedly connected with the tongue while the other or free end, such as a cam follower 67, of the resilient leg is disposed in following engagement with cam surface 23 of adjusting means 17. Resilient means or coil spring 69 is connected between an integrally formed retainer 70 on support 41 and tongue 65 of armature 15 thereby to pivotally urge lever portion 63 of the armature about its associated pivot seat 51 in a downward direction away from end 61 of pole piece 55 (as best seen in FIG. 1). Of course, as previously mentioned, air gap A is the travel or distance between lever portion 63 of armature 15 and pole piece end 61.

A stationary contact 71 is disposed on a stationary switch blade 73 which is mounted to base 43 and connected with a power source by suitable means well known to the art (not shown), and a movable contact 75 is disposed on a movable switch blade 77 which is pivotally mounted to arm 47 of support 41 by spot welding or riveting or the like. Movable switch blade 77 has a free upper end 79 defining an abutment for driven engagement with depending tongue 65 of armature 15 to control the making and breaking engagement of movable contact 75 with stationary contact 71. As well known in the art, an electrical circuit through stationary switch blade 73, stationary contact 71, movable switch blade 75, movable contact 77 and support arm 47 is controlled by the making and breaking of the contacts for controlling the energization and de-energization of a device (not shown) adapted to be controlled by electrical control device 11. To complete the description of electrical control device 11, support arms 45, 47 and bifurcated portion 49 of support arm 47, which provides pivotal seat 51 for armature 15, generally constitutes a path for magnetic flux between electromagnet 13 and the armature, and it is apparent that an external source of power may be connected to energize coil 57 of electromagnet 13. If more detailed information is desired with respect to the construction and assembly of the components of electrical control device 11, other than adjusting means 17 thereof, reference may be had to the D. E. Moran U.S. Pat. No. 2,831,934 issued Apr. 22, 1958.

OPERATION

As previously mentioned adjusting means 17 may be universally employed in several different sizes or electrical ratings of electrical control device 11 to adjust air gap A; therefore, in order to simplify the following discussion concerning the setting of the air gap, assume that the electrical control device is one which requires air gap adjustment within the predetermined adjusting range BB′ in the graphical representation of FIG. 6. In order to adjustably set air gap A of this particular electrical control device 11, a tool (not shown) may be inserted into tool receiving recess 35 of adjusting means 17 for manually exerting the applied adjusting force thereon to adjustably alter air gap A of armature lever portion 63 with respect to free end 61 of pole piece 55 in electromagnet 13. The applied adjusting force is then manually exerted through the tool to effect rotational movement of adjusting means 17 in one of opposite rotational directions, and as noted hereinabove, the threaded driving engagement of threaded shank 21 with its associated support opening 39 effects conjoint linear movement of the adjusting means upon the applied adjusting force rotation thereof.

Upon such conjoint rotational and linear movement of adjusting means 17, shank portion 21 thereof is linearly moved inwardly or rightwardly (as seen in FIG. 1). Cam surface 23 of adjusting means 17 is rotated so as to displace its low end 27 from cam follower 67 of resilient leg 31 and bring high end 29 of the cam surface into camming engagement with the cam follower, as illustrated by the cam surface movement in line OC in the graphical representation of FIG. 6, and the linear movement of shank portion 21 is shown by line OD. When adjusting means 17 has been so rotated one complete revolution, i.e., through its adjusting range OB, in response to the applied adjusting force movement thereof, cam surface step 33 is brought into registry with cam follower 67 of resilient leg 31. Upon the establishment of such registration, the compressive force of resilient leg 31 moves or drops its cam follower 67 off high end 29 of cam surface 23 back into camming engagement with low end 27 of the cam surface, as exemplified by the line CEB in the graph of FIG. 6. In this manner, when adjusting means 17 is rotated through its adjusting range OB, it is automatically reset for further rotation in response to the applied adjusting force thereon through the next successive adjusting range BB′ with cam follower 67 of resilient leg 31 disposed in following engagement with low end 27 of cam surface 33. Of course, this applied adjusting force movement of adjusting means 17 is translated through the following engagement therewith of cam follower 67 on resilient leg 31 into pivotal movement of armature 15 about its pivot seat 51 on bifurcated portions 49 of support arm 47, and such pivotal movement of the armature is in opposition to the compressive force of spring 69. The resultant movement of armature 15, as shown by line OE in FIG. 6, in response to the corresponding conjoint rotational and linear movements cam surface 23 and shank portion 21 of adjusting means 17, as respectively shown by lines OC and OD in FIG. 6, is effective to pivotally or adjustably move lever portion 63 of the armature away from pole piece free end 61 of electromagnet 13 to adjustably alter air gap A.

As previously mentioned, it was assumed that air gap A of the particular size or electrical rating of electrical control device 11 was within the predetermined adjusting range BB′ in the graphical representation of FIG. 6 for adjusting means 17. Therefore, having been adjustably moved through its initial adjusting range OB and automatically reset into the adjusting range BB′, as described above, adjusting means 17 may now be further rotatably and linearly moved in response to the applied adjusting force thereon to select the at-rest position of lever portion 63 with respect to pole piece free end 61, i.e., to adjustably alter air gap A, at which a predetermined pick-up voltage of electromagnet 13 will be operable to attract armature 15 into magnetic holding engagement with pole piece 55.

In order to attain the selected at-rest position of armature 15, adjusting means 17 is further conjointly rotatably and linearly moved in response to the applied adjusting force thereon within the adjusting range BB′, and cam surface 23 is thereby further rotated in the one opposite rotational direction so as to again displace its low end 27 from cam follower 67 resilient leg 31 and move the high end 29 of the cam surface toward camming engagement with the cam follower. As cam follower 67 is thusly driven up the rise of cam surface 23 and the cam surface is linearly moved away from the cam follower in response to the conjoint rotational and linear movements of adjusting means 17, as respectively illustrated along lines BC′ and DD′ within adjusting range BB′ in the graphical representation of FIG. 6, the resultant or pivoting movement of armature 15 is shown along line DE′. In effecting this resultant movement of armature 15, the driving or camming engagement of cam surface 23 with cam follower 67 of resilient leg 31 effects further displacement thereof so as to further pivotally move lever portion 63 of the armature about its pivot seat 51 on bifurcated portions 49 of support arm 47 and generally in the direction away from pole piece 55 of electromagnet 13 thereby further effecting the adjustably altering of air gap A. When the conjoint rotative and linear movement of adjusting means 17 effects such resultant movement of lever portion 63 of armature 15 into its selected at-rest position, air gap A is adjustably altered so that the lever portion of the armature may be attracted into magnetic holding engagement with free end 61 of pole piece 55 in electromagnet 13 at a selected or predetermined pick-up voltage upon the energization thereof.

With armature 15 adjustably disposed in its selected at-rest position and air gap A so adjusted, coil 57 of electromagnet 13 may be energized from its power source (not shown), and such energization sets up a flux path generally through pole piece 55, support 41 and armature 15. When the voltage established by the energization of electromagnet coil 57 attains a predetermined value, i.e., the selected pick-up voltage, pole piece 55 of electromagnet 13 will attract lever portion 63 of armature 15 into magnetic holding engagement with free end 61 of the pole piece. This attraction of armature 15 into magnetic holding engagement with pole piece 55 of electromagnet 13, of course, effects pivotal movement of the armature with characteristic snap action about its pivot seat 51 on bifurcated portions 49 of support arm 47 against the opposing compressive force of spring 69. When armature 15 is so attracted from its selected at-rest position through air gap A into magnetic holding engagement with electromagnet pole piece 55, tongue 65 of the armature is also pivotally moved about pivot seat 51 into driving engagement with abutment 79 on movable switch blade 77 driving it rightwardly (as best seen in FIG. 2) so as to break movable contact 77 from stationary contact 71. This pivotal movement of armature 15 is also effective to conjointly pivot resilient leg 31 to disengage its cam follower 67 from cam surface 23. With contacts 71, 77 so broken, the electrical circuit (not shown) through electrical control device 11 is interrupted thereby to interrupt the energization of the electrical device (not shown) connected in electrical circuit relation with the electrical control device. Of course, when coil 57 of electromagnet 13 is de-energized, at least to a predetermined drop-out voltage value thereof, the magnetic field created by the energized coil is correspondingly reduced. Therefore, when the voltage is reduced to the drop-out value, the compressive force of spring 69 acting on tongue 63 of armature 15 overcomes the magnetic attraction of the armature with electromagnet pole piece 55 and pivotally moves or returns the armature to its selected at-rest position to re-establish air gap A. Upon the return pivotal movement of armature 15 to its selected at-rest position in response to the compressive force of spring 69 acting thereon, cam follower 67 of resilient leg 31 is returned into following engagement with cam surface 23 against the compressive force of the resilient leg thereby to maintain the selected at-rest position of the armature and to insure a generally constant air gap A for the subsequent energization of electrical control device 11 in the same manner as described above.

In view of the foregoing, it is now apparent that a novel electrical control device 11 and novel adjusting and operating methods of an electrical control device are provided meeting the objects and advantageous features set out hereinbefore, as well as others. It is contemplated that changes as to the precise configurations, shapes, details and connections of the various component constructions, as well as to the precise steps of the adjusting and operating methods, set forth herein for purposes of disclosure may be made by those having ordinary skill in the art without departing from the spirit of the invention or the scope thereof.

What we claim as new and desire to secure by Letters Patent of the United States is:

1. An electrical control device comprising an electromagnet, means adapted for attraction from a generally at-rest position through an air gap into magnetic holding engagement with said electromagnet upon its energization, means rotatable in response to an applied adjusting force thereon for adjusting said attraction means toward a selected at-rest position thereof, said adjusting means including means engaged with said attraction means and operable generally upon the applied adjusting force rotation of said adjusting means for camming said attraction means in one direction toward the selected at-rest position thereof, and means for mounting said adjusting means so that it is rotatable and also conjointly linearly movable in another direction generally opposite the one direction away from the engagement of said camming means with said attraction means in following engagement therewith so that the resultant of the movements in the one and another directions of said attraction means is a function of the conjoint rotatable and linear movements of said adjusting means in response to the applied adjusting force thereon to adjustably alter the air gap.

2. The electrical control device as set forth in claim 1 wherein said adjusting means further includes a cam surface engaged with said attraction means and extending generally across the path in which said adjusting means is linearly movable.

3. The electrical control device as set forth in claim 1 wherein said adjusting means further includes means associated with said mounting means for effecting the linear movement of said adjusting means in response to the applied adjusting force thereon.

4. The electrical control device as set forth in claim 3 wherein said linear movement effecting means includes a plurality of threads threadedly engaged with said mounting means.

5. The electrical control device as set forth in claim 1 wherein said adjusting means further includes a cam surface on said camming means and a threaded shank engaged with said attraction means and said mounting means, respectively, said cam surface and said threaded shank being conjointly rotatable in response to the applied adjusting force so that said cam surface drives said attraction means in the one direction and the threaded engagement of said threaded shank and said mounting means effects the conjoint linear movement of said attraction means in the another direction.

6. In an electrical control device having an electromagnet, and means adapted for attraction from a generally at-rest position through an air gap into magnetic holding engagement with the electromagnet upon its energization; the combination therewith comprising means engaged with the attraction means and movable through a plurality of predetermined adjusting ranges for driving the attraction means toward selected at-rest positions to alter the air gap, the driving means being movable in response to an applied adjusting force thereon in one of the predetermined adjusting ranges to drive the attraction means to one of the selected at-rest positions so as to alter the air gap, and the driving means including means for automatically resetting it into at least another of the predetermined adjusting ranges upon the applied adjusting force movement of the driving means through the one predetermined adjusting range, the driving means being operable generally in response to the applied adjusting force movement thereof in the other predetermined adjusting range to effect further driving of the attraction means toward at least another of the selected at-rest positions thereof to further alter the air gap.

7. The electrical control device as set forth in claim 6, wherein the driving means includes a cam surface disposed in camming engagement with the attraction means, the camming engagement of the cam surface with the attraction means effecting the driving thereof toward the one and the at least other selected at-rest positions upon the applied adjusting force movement of the driving means.

8. The electrical control device as set forth in claim 6, further comprising means for mounting the driving means so that it is conjointly rotatably and linearly movable in the device with respect to the attraction means.

9. The electrical control device as set forth in claim 8, wherein the resultant movement of the attraction means toward the one and the at least other selected at-rest positions thereof to alter the air gap is a function of both the rotatable and the linear movements of the driving means in response to the applied adjusting force thereon.

10. The electrical control device as set forth in claim 8, wherein the driving means includes means for threadedly engaging the mounting means to effect the linear movement of the driving means in response to the applied adjusting force thereon.

11. The electrical control device as set forth in claim 8, wherein the driving means includes a cam surface and a threaded shank respectively operably engaged with the attraction means and the mounting means, the cam surface and threaded shank being conjointly rotatable upon the applied adjusting force movement of the driving means so that the cam surface effects the driving of the attraction means toward the one and the at least other at-rest positions thereof and the linear movement of the driving means effected by the threaded engagement of the threaded shank and the mounting means upon the applied adjusting force movement of the driving means tending to move the camming surface in a linear direction from its engagement with the attraction means.

12. The electrical control device as set forth in claim 6, wherein the driving means includes a cam surface having a predetermined rise, and the automatically resetting means being generally constituted by means in the cam surface for effecting the translation of the attraction means from a higher rise portion of the cam surface to a lower rise portion thereof upon the applied adjusting force movement of the driving means through at least the one predetermined adjusting range.

13. The electrical control device as set forth in claim 12, wherein the translation effecting means is a step in the cam surface between the higher and lower rise portions thereof.

14. An electrical control device comprising a support, an electromagnet mounted to said support including a pole piece adapted for magnetization upon the energization of said electromagnet, an armature pivotally mounted to said support and adapted for attraction from a generally at-rest position through an air gap into magnetic holding engagement with said pole piece when it is magnetized, a generally resilient leg portion on said armature, resilient means engaged with said armature for urging it toward the at-rest position thereof, a threaded aperture in said support adjacent said resilient leg portion, means for adjusting the at-rest position of said armature to adjustably alter the air gap between said armature and said pole piece, said adjusting means including a threaded shank portion threadedly received in said threaded aperture in said support so as to be generally linearly movable with respect to said resilient leg portion, a head portion integral with said shank portion including a cam surface having a generally continuous predetermined rise between a low rise portion and a high rise portion thereof and said cam surface being disposed in camming engagement with said resilient leg portion for biasing said armature against the force of said resilient means, said adjusting means being rotatable in response to a manually applied force thereon to conjointly rotate the cam surface generally from its low rise portion toward its high rise portion against the resilient leg portion so as to pivot said armature generally in one direction against the force of said resilient means toward a selected at-rest position to adjustably alter the air gap, and the threaded engagement of said shank with said threaded aperture in said support tending to move said camming surface generally linearly in another direction opposite the one direction away from said resilient leg portion upon the manually applied force rotation of the adjusting means so as to effect pivoting of said armature in the another direction in response to the force of said resilient leg portion acting thereon, the resultant movements of said armature in said one another directions being a function of the rotatable and linear movement of said adjusting means.

15. A method of adjusting an air gap in an electrical control device between an electromagnet thereof and means adapted for attraction from a generally at-rest position into magnetic holding engagement with the electromagnet, the method comprising rotating camming means engaged with the attraction means so as to cam the attraction means generally in one direction and simultaneously moving the camming means linearly in another direction generally opposite the one direction with the attraction means in following engagement therewith so that the resultant movement of the attraction means is a function of the simultaneous rotational and lineal movements of the camming means and the resultant movement causes the adjustable alteration of the air gap.

16. The method as set forth in claim 15 wherein the camming means includes a cam surface engaged with the attraction means and having a predetermined rise between a low rise portion and a high rise portion thereon, the cam surface being rotated toward its high rise portion to effect the movement of the attraction means in the one direction and the cam surface also being simultaneously linearly moved in the another direction to effect the movement of the attraction means therewith in the another direction during the rotating and simultaneously moving step.

17. The method as set forth in claim 15 wherein the rotating and simultaneously moving step includes driving a part of the camming means through a threaded engagement with means for mounting it for effecting movement of the camming means in the another direction.

18. In an electrical control device having an electromagnet, and means adapted for attraction from an at-rest position through an air gap into magnetic holding engagement with the electromagnet upon its energization; a method of operating means through a plurality of predetermined adjusting ranges and engaged with the attraction means for adjusting it toward a selected at-rest position to adjustably alter the air gap, the method comprising the steps of:

a. moving the adjusting means within one of the predetermined adjusting ranges in response to an applied adjusting force to drive the attraction means to a selected one of the at-rest positions thereof so as to adjustably alter the air gap; and b. resetting the adjusting means automatically upon its applied adjusting force movement through the one predetermined adjusting range into at least another of the predetermined adjusting ranges and operating the adjusting means therein to effect the further driving of the attraction means to at least another selected one of the at-rest positions thereof to further adjustably alter the air gap.

19. The method as set forth in claim 18, wherein the adjusting means includes a cam surface engaged with the attraction means and having a predetermined rise between a generally low rise portion and a generally high rise portion thereof, and wherein the resetting and operating step includes translating the attraction means from the high rise portion to the low rise portion upon the applied force movement of the adjusting means through the one predetermined adjusting range.

20. In an electrical control device having an electromagnet, and means adapted for attraction from an at-rest position through an air gap into magnetic holding engagement with the electromagnet; a method of operating means through a plurality of predetermined adjusting ranges for camming the attraction means toward a selected at-rest position thereof to adjustably alter the air gap, the method comprising the steps of:

a. rotating and linearly moving the camming means within one of the predetermined adjusting ranges to effect the camming of the attraction means so that the resultant movement of the attraction means toward a selected one of the at-rest positions thereof to adjustably alter the air gap is a function of the rotating and the linear moving of the camming means; and b. resetting the camming means automatically upon the movement thereof through the one predetermined adjusting range into at least another of the predetermined adjusting ranges and repeating the rotating and the linear moving of the camming means within the at least another predetermined adjusting range for further effecting the resultant movement of the attraction means toward at least another selected one of the at-rest positions in the same functional relationship with respect to the rotating and linear moving of the camming means to further adjustably alter the air gap.

21. In an electrical control device having an electromagnet, and means adapted for attraction from a generally at-rest position through an air gap into magnetic holding engagement with the electromagnet; the combination therewith comprising means for adjusting the at-rest position of the attraction means with respect to the electromagnet to adjustably alter the air gap therebetween including means engaged with the attraction means and operable generally in response to a rotative applied force on the adjusting means for camming the attraction means generally in one direction, and means for converting the rotation of the adjusting means into generally linear movement so as to move the camming means in another direction generally opposite the one direction with the attraction means in the following engagement with the camming means, the resultant movements in the one and another directions of the attraction means being a function of the rotational and lineal movements of the camming means wherein the attraction means is driven toward a selected at-rest position with respect to the electromagnet to alter the air gap.

22. An electrical control device comprising an electromagnet, an armature movable through an air gap for magnetic holding engagement with said electromagnet, means rotatable in response to an applied force thereon for adjusting the air gap between said armature and said electromagnet, said adjusting means including a cam surface having a low portion and a high portion on said cam face for camming engagement with at least a part of said armature, said adjusting means being rotatable in response to the applied force to rotate said high portion of said cam surface into engagement with said at least part of said armature so as to adjustably move said armature with respect to said electromagnet and adjust the air gap therebetween, and means on said cam surface for automatically translating said at least part of said armature from said high portion of said cam surface to said low portion thereof upon predetermined rotational movement of said adjusting means in response to the applied force thereon.

23. The electrical control device as set forth in claim 22 wherein said cam surface includes a generally spiral rise between said low portion of said cam surface and said high portion thereof.

24. The electrical control device as set forth in claim 22 wherein said automatically translating means comprises a step in said cam surface between said low portion and said high portion thereof.

25. In an electrical control device having an electromagnet, an armature movable through an air gap for magnetic holding engagement with the electromagnet, and means rotatable in response to an applied force thereon for adjusting the air gap between the armature and the electromagnet with at least a part of the armature being disposed in following engagement with the adjusting means; the improvement wherein said adjusting means comprises a cam surface having a rise between a low portion and a high portion on said cam surface for camming engagement with said at least part of said armature, said adjusting means being rotatable in response to the applied force thereon to rotate said high portion of said cam surface into the camming engagement with said at least part of said armature so as to adjustably move said armature generally in one direction with respect to said electromagnet and adjust the air gap therebetween, and means on said adjusting means for conjointly linearly moving said cam surface in another direction generally opposite the one direction away from said at least part of said armature upon the rotation of said adjusting means so that the resultant movement of said armature upon the adjusting of the air gap is a function of the conjoint rotatable and linear movement of said cam surface in response to the applied force acting on said adjusting means.

26. In an electrical control device having an electromagnet, an armature movable through an air gap for magnetic holding engagement with the electromagnet, and means engaged with at least a part of the armature and rotatable in response to an applied force for adjusting the armature with respect to the electromagnet to alter the air gap therebetween; the improvement wherein the adjusting means comprises means operable generally in response to the applied force rotation of said adjusting means for conjointly moving it generally linearly between a plurality of predetermined armature adjusting ranges with said adjusting means being operable within each of the ranges to adjust said armature with respect to said electromagnet so as to alter the air gap, and means on said adjusting means for automatically translating said at least part of said armature from one of the ranges to another thereof upon a predetermined applied force rotation of said adjusting means.

* * * * *

UNITED STATES PATENT AND TRADEMARK OFFICE

CERTIFICATE OF CORRECTION

PATENT NO. : 4,008,449

DATED : February 15, 1977

INVENTOR(S) : George E. Morris & Ronald W. Poling

It is certified that error appears in the above-identified patent and that said Letters Patent are hereby corrected as shown below:

Col. 5, line 5, delete "therefore" and insert --therefor--.
Col. 13, line 34, after "one" insert --and--.

Signed and Sealed this

Fourteenth Day of June 1977

[SEAL]

*Attest:*

RUTH C. MASON
*Attesting Officer*

C. MARSHALL DANN
*Commissioner of Patents and Trademarks*